US007264526B2

(12) United States Patent
Kim et al.

(10) Patent No.: US 7,264,526 B2
(45) Date of Patent: Sep. 4, 2007

(54) METHOD OF MANUFACTURING BARRIER RIBS FOR PDP BY CAPILLARY MOLDING OF PASTE AND PASTE COMPOSITIONS THEREFOR

(75) Inventors: Yong Seog Kim, Seoul (KR); Yong Ho Kim, Seoul (KR); Sung Won Cho, Seoul (KR)

(73) Assignee: LG Electronics Inc., Seoul (KR)

( * ) Notice: Subject to any disclaimer, the term of this patent is extended or adjusted under 35 U.S.C. 154(b) by 127 days.

(21) Appl. No.: 10/521,196

(22) PCT Filed: Jul. 15, 2003

(86) PCT No.: PCT/KR03/01401

§ 371 (c)(1),
(2), (4) Date: Dec. 20, 2005

(87) PCT Pub. No.: WO2004/008473

PCT Pub. Date: Jan. 22, 2004

(65) Prior Publication Data

US 2006/0121815 A1 Jun. 8, 2006

(30) Foreign Application Priority Data

Jul. 15, 2002 (KR) ..... 10-2002-0041061

(51) Int. Cl.
*H01J 9/00* (2006.01)
*H01J 9/24* (2006.01)

(52) U.S. Cl. ..... 445/24; 445/23

(58) Field of Classification Search ..... None
See application file for complete search history.

(56) References Cited

U.S. PATENT DOCUMENTS

| | | | | |
|---|---|---|---|---|
| 2003/0098528 | A1* | 5/2003 | Chiu et al. | 264/603 |
| 2003/0100192 | A1* | 5/2003 | Chiu | 438/761 |
| 2003/0108664 | A1* | 6/2003 | Kodas et al. | 427/125 |
| 2006/0043634 | A1* | 3/2006 | Corrigan | 264/166 |

FOREIGN PATENT DOCUMENTS

| | | |
|---|---|---|
| JP | 10-221522 | 8/1998 |
| JP | 11-213874 | 8/1999 |
| JP | 2000-243267 | 9/2000 |
| JP | 2002-068761 | 3/2002 |
| JP | 2003-20253 | 1/2003 |
| KR | 2003-26881 | 4/2003 |
| KR | 2003-027998 | 4/2003 |

* cited by examiner

*Primary Examiner*—Joseph Williams
*Assistant Examiner*—Bumsuk Won
(74) *Attorney, Agent, or Firm*—McKenna Long & Aldridge LLP

(57) ABSTRACT

Disclosed is a method of manufacturing rear plate barrier ribs for Plasma Display Panel (PDP), which includes the steps of: forming barrier ribs by infiltrating the barrier rib forming paste into grooves of a mold by using the capillary phenomenon, and then sintering the paste. This method causes rare environmental pollution, enables to make barrier ribs having fine and complex shapes and reduces material costs required for the barrier rib. Thus, the method may improve quality of PDP and reduce manufacture costs of the rear plate.

8 Claims, 8 Drawing Sheets

METHOD OF MANUFACTURING BARRIER RIBS FOR PDP BY CAPILLARY MOLDING OF PASTE AND PASTE COMPOSITIONS THEREFOR

TECHNICAL FIELD

The present invention relates to a method of manufacturing rear plate barrier ribs of PDP (Plasma Display Panel) by forming the barrier rib forming paste into grooves of a mold on which a barrier rib shape is imprinted by means of the capillary phenomenon and then plasticizing the formed paste, and paste compositions for forming a thick film used in the method. More particularly, the present invention relates to a method of manufacturing barrier ribs by uniformly coating the paste, which has wetting angle and viscosity of a certain condition to a mold and includes a binder containing thermosetting or photosensitive components, on a glass substrate, then placing the mold on the coated paste, then curing the paste when the paste is infiltrated into grooves of the mold by the capillary phenomenon, and then removing the mold and then sintering the paste.

BACKGROUND ART

A Plasma Display Panel (PDP) is a flat display element, which is mainly used for large-sized display devices over 40 inches because the PDP is thin and light and gives good image quality In the PDP, pixels are formed at points where barrier ribs and address electrodes formed on a rear plate intersect sustain electrodes formed on an front plate to realize an image.

This PDP is schematically shown in FIG. 1. Referring to FIG. 1, a dielectric layer 90 is coated on a rear plate 80 made of a glass or metal substrate, and address electrodes 50 are formed on the rear plate 80 or the dielectric layer 90. Barrier ribs 60 having a long stripe shape are positioned between the address electrodes 50, and fluorescent substances are coated on the surface between the barrier ribs 60 in order to compose a sub-pixel. A sustain electrode 40 is in an front plate 1 made of glass, and a dielectric layer 20 and an MgO protective layer 30 exist below the sustain electrode 40. Thus, when the front plate 10 is combined with the rear plate 90, there generates a plurality of pixel spaces separated by the barrier ribs 60. These separated spaces are filled with He/Xe gas or Ne/Xe gas so as to create plasma therein when voltage is applied to the sustain electrode 40 and the address electrode 50. In addition, vacuum ultra violet generated from the plasma excites the fluorescent substances coated on sides of the barrier ribs and lowermost surfaces between the barrier ribs, thereby creating red, green and blue visible light.

In order to form the barrier ribs, the sand blasting is mainly used. FIG. 2 schematically shows sequential processes of the sand blasting. As proposed in Japanese Patent Filing No. 11-120905 and Korean Patent Filing No. 2000-10322 in detail, the sand blasting is executed according to the following procedure: coating paste containing glass powder for barrier rib and a ceramic filler on a rear plate substrate such as a glass board and then drying, which is repeated several times until to have a thickness of about 200 μm; coating photoresist on the dried thick film; and developing the film except portions corresponding to the barrier ribs so that areas except the barrier ribs are removed. At this time, the exposed portion is determined according to the type of the used photoresist film. And then, ceramic powder such as calcium carbonate ($CaCO_3$) is sprayed together with pressed air onto the film coated with photoresist in order to etch the portions where the photoresist is removed, thereby forming the barrier ribs.

This sand blasting is relatively stable and thus frequently used to make the rear plate barrier ribs of the existing PDP. However, the sand blasting has drawbacks in the facts that many and complicated processes are required to manufacture the barrier ribs, the side shapes of the manufactured barrier ribs are not uniform, and the drying and coating process is executed very slowly.

Recently, as the contrast of the PDP improves, the pitch of the sub-pixel between the barrier ribs is decreased from 420 μm to 200 μm, which needs a method for making a barrier rib having a thickness less than 50 μm. In case the pitch of the sub-pixel is 200 μm and the thickness of the barrier rib is 50 μm, the open ratio becomes 50%, while in case the cell pitch is 100 μm, the open ratio becomes 0%, and thereby is it impossible to compose the display panel. Thus, it is required that the barrier rib has a thickness between 20 μm and 30 μm. However, the sand blasting is substantially impossible to obtain such thickness. Since ceramic powder and high-pressure gas are used for etching to form the barrier ribs, it is hardly possible to make a thin barrier rib since the barrier rib is broken due to the mechanical energy of the ceramic powder and the high-pressure gas. In addition, if the pitch of the sub-pixel is 430 μm and the width of the barrier rib is 50 μm when making the barrier ribs using the sand blasting, at maximum 90% of the volume of the thick film is etched and abolished. Thus, the sand blasting generates a large amount of wastes. Furthermore, since the thick film has glass frit containing a large amount of lead monoxide, the wastes may cause environmental pollution.

As another example, a method for forming barrier ribs by etching the sintered glass (SID 01 Digest, p 537 (2001).). This method is now briefly described. At first, a thick film having a predetermined thickness is formed on a glass substrate by using the paste including glass powder and ceramic powder. The thick film may be formed by using the well-known printing and drying process repeatedly, or by lamination using a dry film (or, a green tape). If the thick film is formed, the thick film is heated up to a predetermined temperature by means of a predetermined temperature profile, and then sintered to make a thick film made of barrier rib materials. A photosensitive film is coated or laminated on the surface of the sintered thick film, and then the photosensitive film is selectively exposed by using a mask. The exposed specimen is developed to form an etching protective pattern film by means of the photosensitive film, and then the exposed thick film is etched using a suitable etching liquid. And then, through washing and drying barrier ribs for PDP are finally manufactured. This method may advantageously make a barrier rib having fine and complex figure since it does not require the etching process using mechanical impacts. However, the dense glass thick film is generally slowly etched, particularly experiencing the isotropic-etching. Thus, Photonics Co. provides a method for improving a barrier rib forming speed by etching a porous thick film (SID 01 Digest, p 532 (2001)).

Such etching method has some problems as follows.

First, since the barrier rib material layer formed by sintering is etched by an etching solution such as acid, environmental pollution may be caused by wasted water. Since the layer to be etched is thick as much as 120 μm~150 μm, an amount of the wasted water is very significant, thereby requiring much costs for treating the wasted water.

Second, physical features required for the barrier rib material such as electric resistance, dielectric constant, thermal expansion coefficient and reflectivity should be satisfied, and the material should be rapidly etched by the water-based solution. Thus, there are many limitations in selecting the material, and thus the selection of the barrier rib material is very limited.

Third, when applied to a large area, this etching method may hardly obtain a uniform etching speed. In other words, in order to have a uniform etching speed throughout the large area and give a desired shape for the barrier rib of the PDP, the etching conditions should be maintained very accurately. However, to maintain the conditions throughout the large area is very hard, thereby resulting in very low process yield.

DISCLOSURE OF INVENTION

The present invention is designed to solve problems of the prior art by one effort and directed to achieve technical objects desired up to now, as described below.

First, the present invention provides a technique which enables to make barrier ribs with a thin width as much as 10 μm and having not only a simple shape such a strip type but also a closed-cell shape such as meander type, waffle type, honeycomb type and SDR type, though not using the mechanical or chemical etching.

Second, the present invention provides a technique which is may minimize the loss of barrier rib materials so as to prevent environmental pollution due to the industrial waste created during the barrier rib forming process.

Third, the present invention provides a technique which is capable of lowering manufacture costs by simplifying the barrier rib manufacturing process for four steps such as the paste coating, the capillary tube molding, the mold removal and the sintering.

Fourth, the present invention provides a technique which is capable of manufacturing barrier ribs having excellent quality by increasing the mold release property and thus improving yield of the process and stability of the barrier rib shape.

BRIEF DESCRIPTION OF THE DRAWINGS

These and other features, aspects, and advantages of preferred embodiments of the present invention will be more fully described in the following detailed description, taken accompanying drawings. In the drawings.

BEST MODES FOR CARRYING OUT THE INVENTION

Hereinafter, preferred embodiments of the present invention will be described in detail with reference to the accompanying drawings.

A method of manufacturing rear plate barrier ribs for a Plasma Display Panel (PDP) according to the present invention includes the steps of: forming a thick film for barrier ribs by coating barrier rib forming paste, which has a wetting angle to a mold less than 90° and a viscosity in usage state less than 20000 cP and includes thermosetting and/or photosensitive binder component, on a glass or metal substrate (or, glass or metal lower plate); positioning a mold, in which a barrier rib shape is imprinted, above the thick film so that paste is infiltrated into grooves of the mold by means of the capillary phenomenon, and then curing the infiltrated paste; and releasing the mold from the cured barrier ribs and then sintering the barrier ribs.

One of the characteristics of the present invention is that, since the paste is infiltrated into the grooves of the mold in which the barrier rib shape is imprinted, irregularity of the barrier ribs is rarely generated during the etching process and thus industrial waste is nearly not generated due to the etching, so the barrier ribs may be manufactured into a desired shape in an environmentally friendly way.

Thus, in order to execute the capillary molding according to the present invention, it is required to satisfy the following two conditions: (1) a wetting angle of the paste to the mold should be lower than 90°; (2) a viscosity of the paste in usage state should be lower then about 20000 cP.

Figure 1:
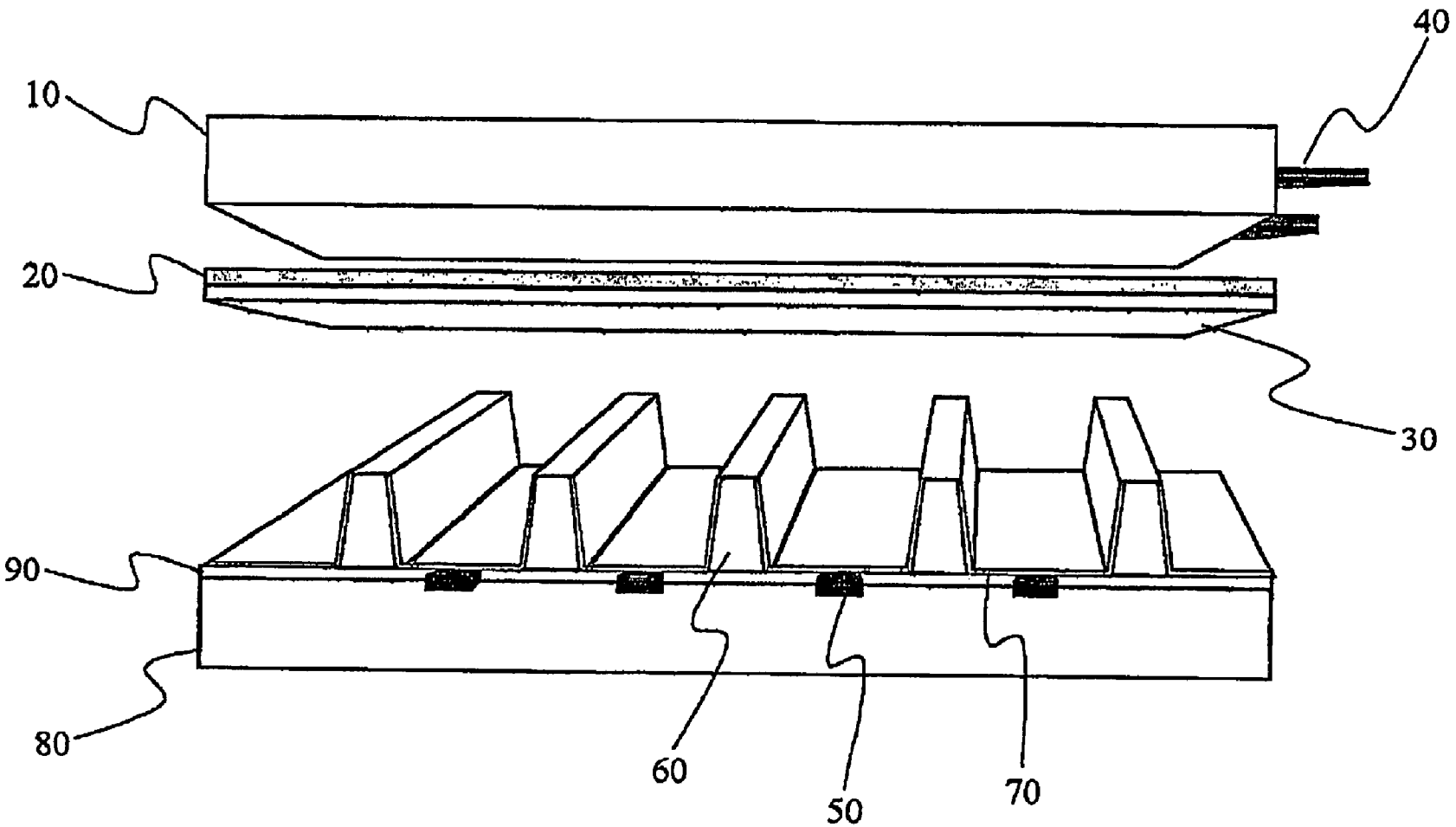
FIG. 1 is a perspective sectional view schematically showing a Plasma Display Panel (PDP)
Figure 2:
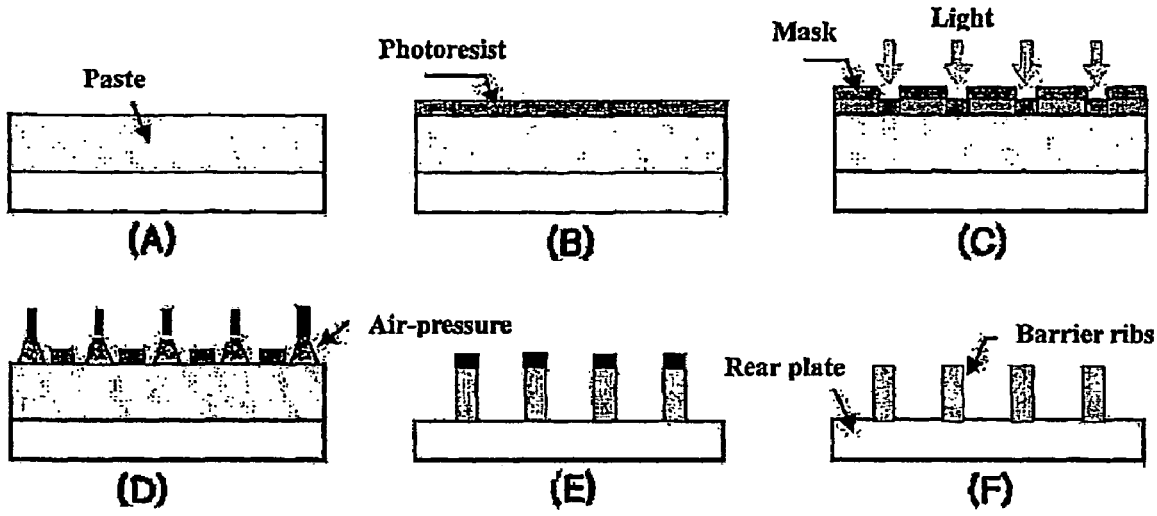
FIG. 2 is a schematic view for illustrating the process for manufacturing barrier ribs by using the sand blasting.
Figure 3:
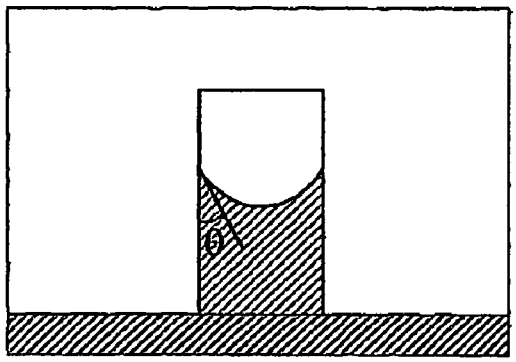
FIG. 3 is a schematic view showing a wetting angle of paste to the mold according to the present invention.
Figure 4:
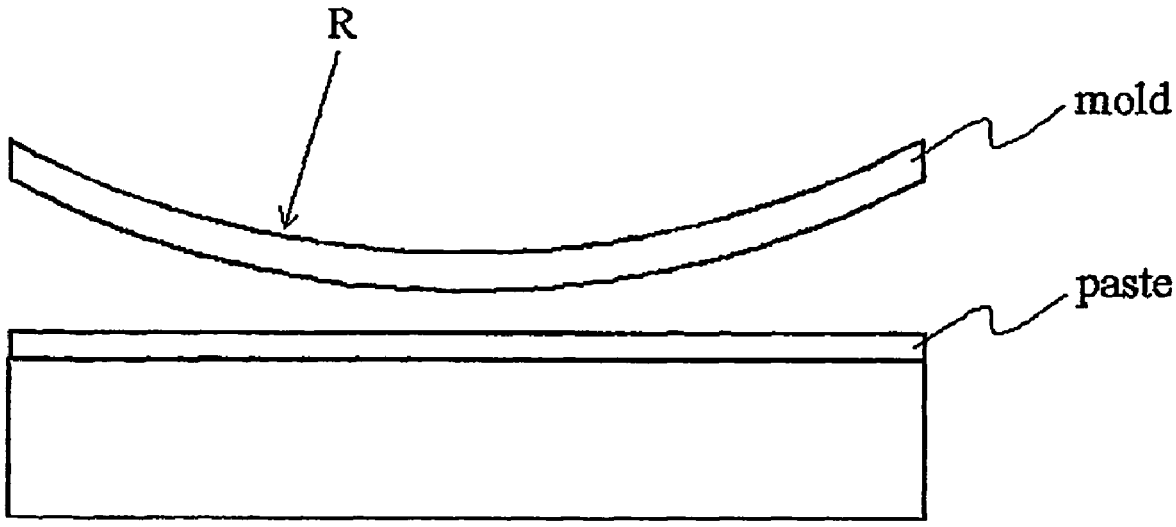
FIG. 4 is a schematic view showing the mold, which is temporarily bent, as one method for preventing the air from being trapped in an upper cavity inside the barrier ribs.

In order to accomplish the first condition that the wetting angle of the paste to the mold is lower than 90°, the paste and the mold should have a suitable surface energy relation. In other words, the wetting property (adhesion force) of the paste toward the mold should be larger than the weight of the paste itself. As shown in FIG. 3, the capillary phenomenon enabling the molding of the barrier ribs may be aroused in contact with the mold only when the wetting angle (θ) between them is lower than 90°. The paste includes thermosetting or photosensitive binder as a component for forming the barrier ribs. Since this binder basically has a surface tension relatively lower than metal or ceramic, the wetting property with the mold is increased. However, if the paste has too much components having relatively low affinity, the wetting property is decreased so the capillary phenomenon is hardly happened.

In order to satisfy the second condition that the viscosity of the paste is lower than about 20000 cP, preferably lower then 15000 cP, the viscosity should be lower than that of the paste generally used for the barrier rib manufacture. The paste for manufacturing barrier ribs generally has a viscosity of about 100,000 cP or above. However, if the viscosity exceeds about 20000 cP, the cohesive force of the paste itself is too high so the paste does not have flow ability sufficient for the capillary phenomenon. On the other hand, fir the viscosity is too low, the wetting angle to the barrier ribs becomes over 90° so it is impossible to obtain a desired effect. Thus, the minimum value of the paste viscosity required for accomplishing the method according to the present invention may be defined depending on the set value of the setting angle to the mold.

The viscosity of the paste may be decreased in various ways, for example: (i) using binder component having a low viscosity; (ii) adding a diluting agent having a low viscosity into the paste; (iii) increasing the temperature of the paste in usage state; or (iv) lowering the content of inorganic powder including glass powder and ceramic powder, but not limited to those cases.

In the way (i), the low-viscosity binder is not specially limited in the present invention if it may be used as a curing binder. For example, YH300 (manufactured by Kookdo Chemical Co. Ltd.) or ERL (manufactured by Seechem International Co. Ltd) may be used. The diluting agent used in the way (ii) may lower the viscosity of the paste appropriately without affecting on the reaction of the present invention. For example, LGE (manufactured by Kookdo Chemical Co. Ltd.) may be used. However, if a large amount of diluting agent is added, though the viscosity is lowered, the wetting property to the mold is also lowered as described above, thereby making the desired capillary molding impossible. In addition, if the curing binder has sufficiently low viscosity, there is no need to add the diluting agent. The temperature in usage state in the case of the way (iii) is not specially limited but may be determined suitably depending on the composition of the paste. Though the viscosity is generally lowered as the temperature increases, too high temperature may shorten the service life of the curing agent added to the paste, it may even cause abrupt increase of the viscosity. The temperature in usage state is preferably 50 to 70° C. In the way (iv), the content control of the inorganic powder should be determined on the consideration of the various factors such as an amount required for forming the barrier ribs, an amount suitable for the coupling due to the binder and an amount required for viscosity control. Since the content increase of the solid inorganic powder causes viscosity increase, the amount of the inorganic powder may be determined on the consideration of the viscosity of the used binder and the amount of the diluting agent. The viscosity control may be realized by using one or at least two in combination of the above-exemplified ways, or other ways may also be additionally used.

The capillary molding may be accomplished in a short time only by positioning the mold on the paste thick film upon the substrate, so there is no need to exert separate pressure to the mold . Thus, the present invention does not necessarily use a precise positioning device, which is used in the conventional barrier rib manufacturing method using the mold, but the precise positioning device is also preferred in the present invention.

When the paste is molded in a barrier rib cavity of the closed mold, air may be trapped into the mold, thereby causing a defect, so such air trapping should be preferably prevented. Thus, the capillary molding is preferably executed under the vacuum circumstance. In other words, conducting the capillary molding under the vacuum circumstance may prevent air from being trapped into the barrier rib cavity of the closed mold. The vacuum circumstance is preferably ranged of 600 torr~$10^{-6}$ torr. More preferably, the vacuum circumstance is in the range of 600 torr~10 torr in order to restrain evaporation of organic substances having low boiling point and contained in the paste. As another way to prevent air trapping in the barrier rib cavity of the mold, it is also possible to bend the mold so that a center portion of the mold forms a smooth curve protruded downward, and then conduct molding while slowly spreading the bent mold. In this case, the air flow off while the mold is spread, so the trapping of air may be prevented. When temporarily bending the mold, a diameter (R) of the upper virtual arc may be determined depending on various conditions such as overall size or elasticity of the mold. The diameter (R) is preferably 10 cm to 10 m.

Now, a preferred embodiment of the present invention is described.

At fist, The method of manufacturing rear plate barrier ribs for PDP according to an embodiment of the present invention includes the following steps:

(1) making the paste having a wetting angle to a mold less than 90° and a viscosity in usage state less than 20000 cP by mixing glass powder and ceramic powder so that a mixing ration is in the range between 50:50 and 95:5, and then mixing 2 to 20 wt % of thermosetting and/or photosensitive binder, 0.1 to 10 wt % of thermosetting and/or photosensitive initiator, 0.01 to 10 wt % of surfactant (dispersion agent, defoaming agent or wetting agent) and 0.01 to 5 wt % of coupling agent on the basis of 100 wt % of the mixed powder;

(2) making a thick film by coating the paste on the glass or metal rear plate in the thickness of 5 to 100 μm;

(3) forming barrier ribs by positioning the mold, in which a barrier rib shape is imprinted, on the paste so that the paste is infiltrated into the grooves of the mold by means of the capillary phenomenon;

(4) curing the substrate and the paste filled in the grooves of the mold by heating or UV radiation, and then releasing the mold; and (5) plasticizing the specimen at 450° C. to 600° C. for 0.5 to 1 hour to make the barrier ribs for PDP.

An amount of each component of the paste compositions defined in this specification is in the range which is generally receivable in the art related to the compositions for forming barrier ribs of PDP. Without any special explanation, the range shows a minimum value and a maximum value suitable for the barrier rib forming composition. In the same reason, set conditions such as thickness of the barrier ribs, reaction temperature and reaction time in the manufacturing method are also defined in the range which is receivable for optimized practice.

In the paste of the step (1), 20 to 40 wt % of reactive diluting agent may be preferably further added on the basis of 100 wt % of the mixed powder for the purpose of viscosity decrease, easy mixing and regularity.

The paste making process may use a conventional 3-Roll mill for the mixing. In order to optimize the functions of the added components, the paste making process is preferably conducted by two mixing stages.

At first, glass powder and ceramic powder are put into a ball mill container as much as 20 to 30% on the basis of the volume of the ball mill container, and then 20 to 40 wt % of the reactive diluting agent is added on the basis of 100 wt % of the mixed powder. Here, the dispersion agent and the defoaming agent of the above-mentioned amount are added thereto, and then ball-milled. The milling is executed for 1 to 24 hours depending on the agglomeration level of the powder, preferably 6 to 12 hours, as a first milling.

If the first milling is completed, the binder, the reactive diluting agent, the initiator, the coupling agent and other addition agent (e.g. coupling agent an wetting agent) of the above-mentioned amount are added thereto, and then 3-Roll-milled as a second milling. The 3-Roll milling is also executed 2 to 6 times, preferably 2 or 3 times.

The wetting agent, which is a kind of surfactant, may be added to control a paste infiltration rate into the mold grooves. In addition, the defoaming agent, which is a kind of surfactant, may also be added to remove pores in the paste during the process. The coupling agent is used for increasing adhesive force between the ceramic powder and the thermosetting or photosensitive binder, or between the ceramic powder and the substrate, or the curing strength.

The coating process of step (2) may be conducted in various ways, for example, the screen printing, the die coating, the roll coating, the spin coating and so on.

In the step (3), the mold positioned on the thick film may be selected from ones made by various shape, materials or methods, if a shape of the barrier ribs is imprinted thereon. For example, any of a soft mold made of polymer material by LIGA (Lithography Galvano Abforming) or a hard mold mainly made of nickel may be used.

Figure 5:
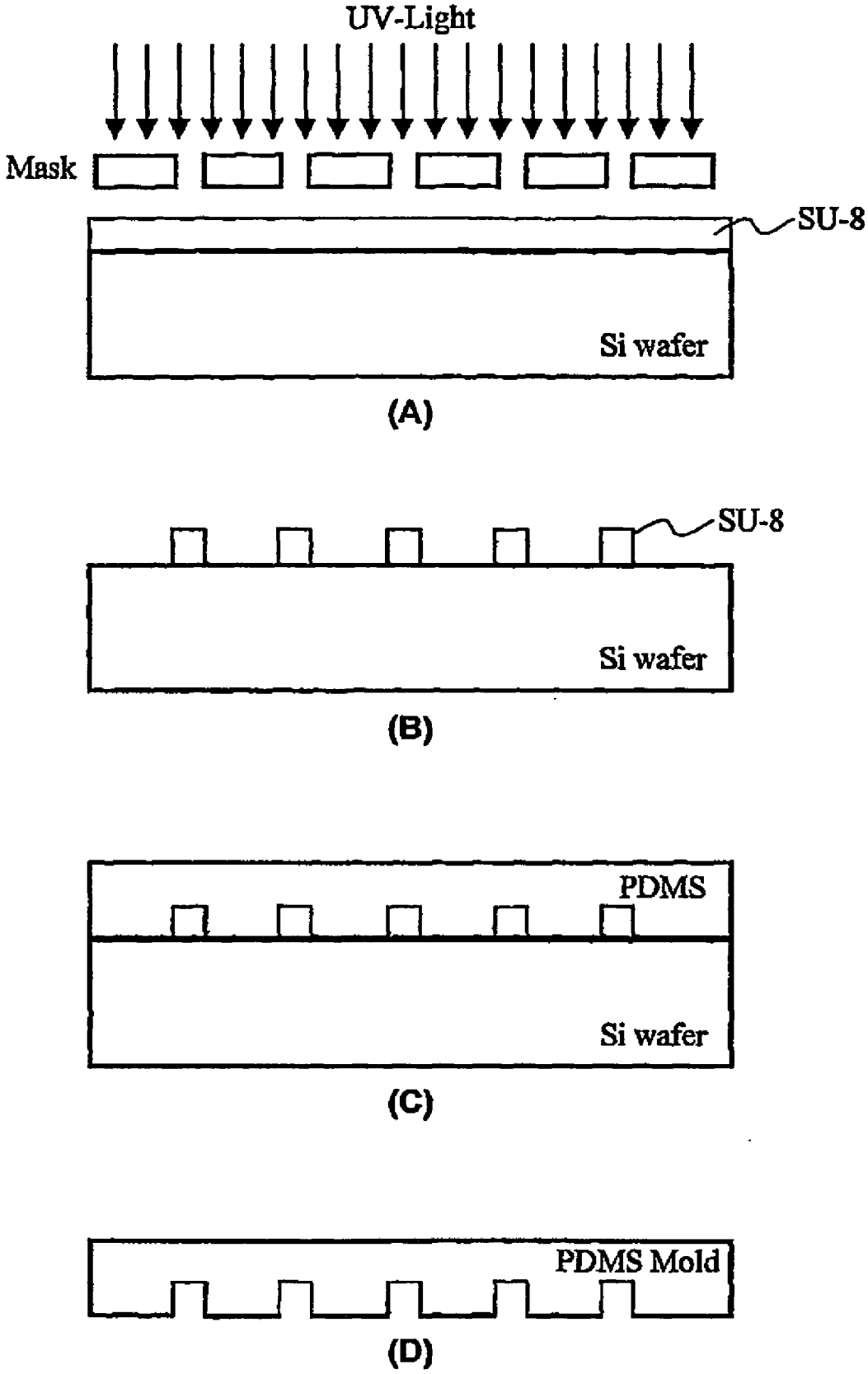
FIG. 5 is a schematic view for illustrating the illustrating the method of manufacturing barrier ribs by using a mold according to an embodiment of the present invention.

FIG. 5 exemplarily shows the process for executing the method of making a mold which may be used in the present invention. After coating the thick film photoresist on the substrate by means of the spin coating, a mask is positioned on the thick film and then UV is radiated (A). Portions which is not protected by the mask using the development liquid (or, portions exposed to UV) are etched to make a basic mold (B). The mold made into the barrier rib shape is coated with polymer materials (PDMS), and then cured (C). Then, the substrate is removed to make the mold (D). Then, the soft mold made in the above way is used. Or else, a soft mold made by electrically plating nickel or its alloy may also be used.

Figure 6:
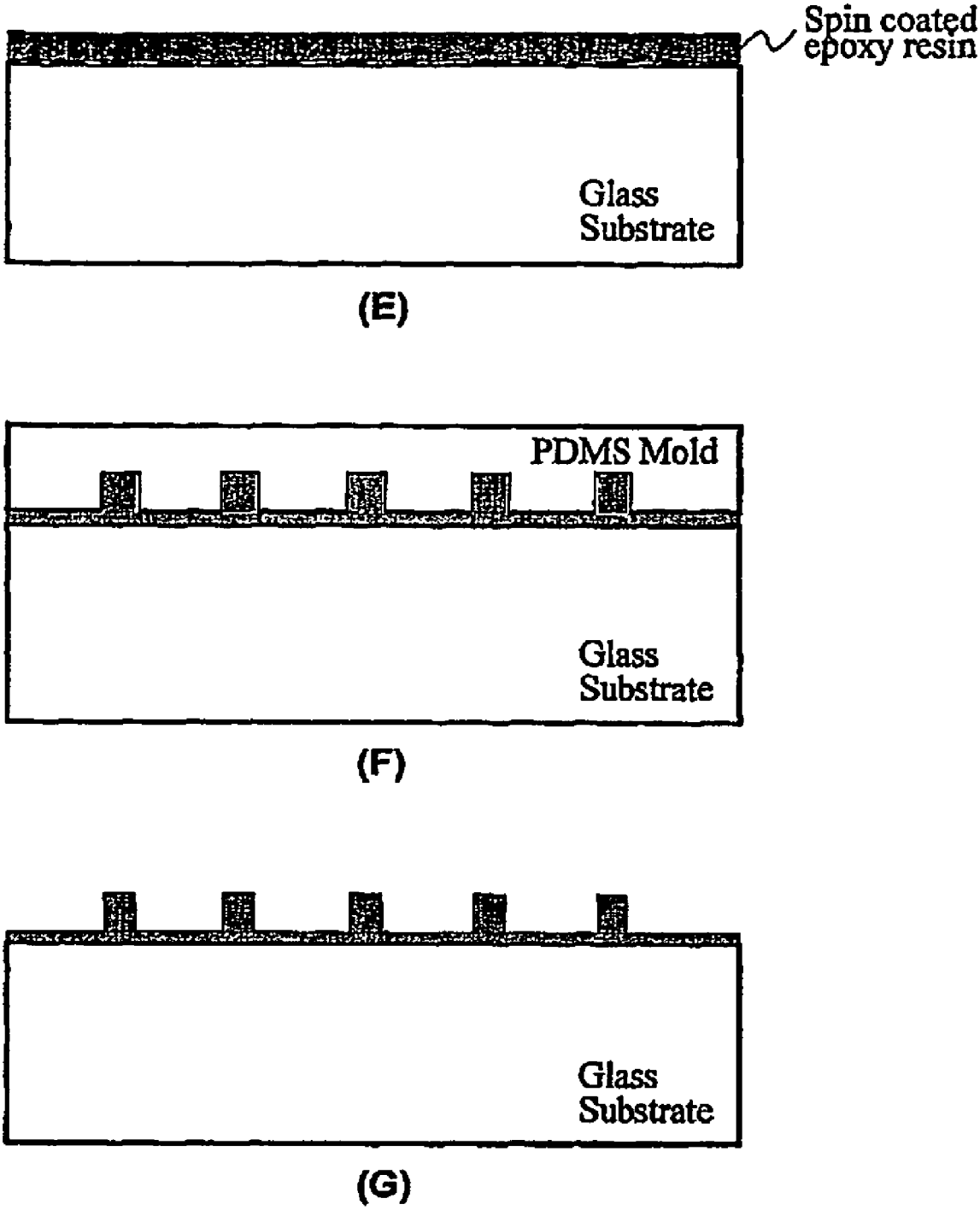
FIG. 6 is a schematic view for partially illustrating the method of manufacturing barrier ribs according to an embodiment of the present invention.

In the step (4), the barrier ribs are cured by either heating the paste molded in the capillary tubes of the mold grooves up to a curing temperature (in case the paste includes thermosetting binder) or radiating UV (in case the paste includes photosensitive binder), and then the mold is removed. This curing process increases strength of the barrier ribs and prevents damage of the barrier ribs, which may happen during the removal of mold, thereby improving productivity of the barrier ribs. As mentioned above, since the present invention forms the barrier ribs by infiltrating the past into the fine pitch mold without using the mechanical or chemical etching, the barrier ribs may be made to have good shape and high aspect ratio. FIG. 6 schematically shows the process of the barrier rib manufacturing method according to the present invention till the removal of mold.

In the step (5), the shaped barrier ribs without the mold is sintered at high temperature in order to remove organic components and sinter the glass powder and the ceramic powder , thereby finally manufacturing the barrier ribs on the glass substrate or the metal substrate.

The present invention also provides paste compositions for forming barrier ribs of PDP, which may be used in the above method.

The paste compositions used for forming barrier ribs according to the present invention have a wetting angle to a mold less than 90° and a viscosity in usage state less than 20000 cP, and the paste compositions include the following components:

(a) 100 wt % of mixed powder of glass powder (a-1) and ceramic powder (a-2) of which a volume ratio is in the range of 50:50 to 95:5;

(b) 2 to 20 wt % of thermosetting and/or photosensitive binder;

(c) 0.1 to 10 wt % of curing initiator;

(d) 0.01 to 10 wt % of surfactant (dispersion agent, deforming agent or wetting agent); and (d) 0.01 to 5 wt % of coupling agent.

As mentioned above in relation to the manufacturing method, the composition is coated on the rear plate of PDP in which the address electrode and the dielectric are formed, to make a thick film, and then infiltrated into grooves of the mold by means of the capillary phenomenon. Then the composition is formed into the barrier ribs shape having a height of 100 to 200 μm and a width of 10 to 100 μm through the thermosetting and/or photosensitive reaction, and then cured to finally form the barrier ribs.

Preferably, 20 to 40 wt % of reactive diluting agent (f) may be further added for the purpose of viscosity decrease, easy mixing and regularity.

The glass powder (a-1) among the mixed powder (a) is a main component for forming the barrier ribs by plasticity, and has an average particle size of 0.1 to 10 μm. As representative examples, the glass powder may adopt PbO—$B_2O_3$—$SiO_2$, $P_2O_5$—$B_2O_3$—$SiO_2$ and $Bi_2O_3$—$B_2O_3$—$SiO_2$ or their mixtures.

The ceramic powder (a-2) is a filling component which is sintered together with the glass powder (a-1) for keeping dielectric constant of the barrier ribs and the shape of barrier ribs during the sintering. The ceramic powder (a-2) may adopt $Al_2O_3$, fused silica, $TiO_2$ and $ZnO_2$, or their mixture, which has an average particle size of 1 to 10 μm.

The binder (b) may use thermosetting resin (b-1) or photosensitive resin (b-2), which are generally used.

The thermosetting resin binder (b-1) may be one selected from phenol resin, urea resin, melamine resin, polyurethane resin, polyester resin, epoxy resin, furan resin, alkyd resin and acrylic resin, or their mixture. Since the curing process is basically required for obtaining the final products, the selected thermosetting binder should be completely resolved below 600° C. without remaining residual carbon. Thus, epoxy and acrylic thermosetting binders are more preferred. Most preferably, bisphenol A, bisphenol F, bisphenol-AD, bisphenol-S, tetramethyl bisphenol-F, tetramethyl bisphenol-AD, tetramethyl bisphenol-S, tetrabromo bisphenol-A and tetrachloro bisphenol-A, which have long bench time at room temperature and do not significantly affect on viscosity when the thermosetting initiator, may be used among the epoxy thermosetting binders. As for the acrylic thermosetting binder, acrylic acid ester monomer is particularly preferably, of which representative examples are as follows: methyl (metha)acrylate, ethyl (metha)acrylate, propyl (metha)acrylate, normal-butyl (metha)acrylate and isobutyl (metha)acrylate.

The photosensitive resin binder (b-2) may be generally classified into acrylic binder and polyene/polythiol binder. The acrylic photosensitive binder includes urethane acrylate, polyester acrylate and epoxy acrylate, while the polyene/polythiol photosensitive binder includes triaryl isocyanurate, diaryl maleirate, trimethylol propaltris and thiol propionate. Since the curing process is basically required for obtaining the final products, the selected photosensitive binder should be completely resolved below 600° C. without remaining residual carbon. Thus, acrylic photosensitive binder is more preferred. In addition, since the binder has low viscosity in order to improve plasticity and releasing property of the products, oligomer is not preferred among the acrylic binders. In the present invention, as for a general reactive acrylic monomer for the photosensitive binder, one selected from the group consisting of isobornyl (metha) acrylate, bornyl (metha)acrylate, tricyclodecanyl (metha) acrylate, dicyclopenanyl (metha)acrylate, cyclohexyl (metha)acrylate, benzyl (metha)acrylate, 4-butylcyclohexyl (metha)acrylate, acryloyl morpholine, 2-hydroxyethyl (metha)acrylate, 2-hydroxypropyl (metha)acrylate, 2-hydroxybutyl (metha)acrylate, methyl (metha)acrylate, ethyl (metha)acrylate, propyl (metha)acrylate, isopropyl (metha)

acrylate, butyl (metha)acrylate, amyl (metha)acrylate, isobutyl (metha)acrylate, t-butyl (metha)acrylate, pentyl (metha)acrylate, isoamyl (metha)acrylate, hexyl (metha) acrylate, heptyl (metha)acrylate, octyl (metha)acrylate, isooctyl (metha)acrylate, 2-ethylhexyl (metha)acrylate, nonyl (metha)acrylate, decyl (metha)acrylate, isodecyl (metha)acrylate, undecyl (metha)acrylate, dodecyl (metha) acrylate, lauryl (metha)acrylate, stearyl (metha)acrylate, isostearyl (metha)acrylate, tetrahydrofurfuryl (metha)acrylate, butoxyethyl (metha)acrylate, ethoxydietylene glycol (metha)acrylate, polyethylene glycol mono (metha)acrylate, poltpropylene glycol mono (metha)acrylate, methoxy ethylene glycol (metha)acrylate, methoxy ethyl (metha)acrylate, methoxy polyethylene glycol (metha)acrylate, methoxy polypropylene glycol (metha)acrylate, diacetone (metha) acrylate, isobutoxy methyl (metha)acrylate, trimethylolpropane tri(metha)acrylate, pentaerythritol tri(metha)acrylate, ethylene glycol di (metha)acrylate, tetra ethylene glycol (metha)acrylate, polyethylene glycol di (metha)acrylate, 1,4-butanediol di (metha)acrylate, 1,6-hexanediol di (metha) acrylate, neopentyl glycol di (metha)acrylate, trimethylolpropanetrioxyethyl (metha)acrylate, or their mixture may be used.

An added amount of the binder (b) is preferably 2 to 20 wt % on the basis of 100 wt % of the mixed powder, more preferably 3 to 15 wt %.

The curing initiator (c) may be classified into thermosetting initiator (c-1) and photosensitive initiator (c-2) depending on the kind of the used binder (b).

The thermosetting initiator (c-1) is selected according to the kind of the thermosetting resin binder (b-1) as a component for inducing the crosslinking reaction between the thermosetting resin binders (b-1) when heating the compositions. Representatively, liquefied or solid initiators of alkyl amine salt, aromatic amine salt, phosphate, dicyan diaminde BF3-amine salt derivatives may be used for the thermosetting resin binder. At this time, this thermosetting initiator is selected from ones which has no curing property at room temperature, but is capable of thermal curing with a long bench time. For example, Diethylene Triamine (DETA), Triethylene Tetramine (TETA), Diethylamino propyl amine (DEAPA), Menthane diamine (MDA), N-aminoethyl piperazine (N-AEP), M-xylene diamine (MXDA), Isophorone diamine (IPDA), Meta phenylene diamine (MPD), 4,4'Dimethyl aniline (DAM or DDM) and Diamino Diphenyl Sulfone (DDS), or their salts are preferred for the thermosetting initiator. More Preferably, one having a long bench time at room temperature and without viscosity increase is preferably selected among the above-mentioned thermosetting resins.

The photosensitive initiator (c-2) is a component for inducing the crosslinking reaction between the photosensitive resins (b-2) when the composition is radiated by infrared ray, visible ray, X-ray, electronic beam, α-ray, β-ray or γ-ray, and selected depending on the kind of the photosensitive resin binder (b-2). Representatively, one selected from acetophenone, acetophenon benzyl ketal, 1-hydroxycyclohexyl phenyl ketone, 2,2-dimethoxy-2-phenylacetophenone, xanthone, fluorenone, benzaldehyde, fluorene, anthraquinone, triphenylamine, carbazole, 3-methylacetophenone, 4-chlorobenzophenone, 4,4-dimethoxybenzophenone, Michler's ketone, benzoin propyl ether, benzoin ethyl ether, benzyl dimethyl ketal, 1-(4-isopropylphenyl)-2-hydroxy-2-methylpropane-1-one, 2-hydroxy-2-methyl-1-phenylpropane-1-one, thioxanthone, diethylthioxantone, 2-isopropyloxanthone, 2-chlorothioxanthone, 2-methyl-1-[4-(methylthio)phenyl]-2-morpholino-propane-1-one and 2,4,6-trimethylbenzoyl diphenylphosphine oxide, or their mixtures may be used for the photosensitive initiator (c-2).

The added amount of the curing agent (c) is preferably 0.1 to 10 wt % on the basis of 100 wt % of the mixed powder, more preferably 0.2 to 5 wt %.

The surfactant (d) may be classified into dispersion agent (d-1), deforming agent (d-2) and wetting agent (d-3) depending on its usage.

The dispersion agent (d-1) is a component for helping the glass powder and the ceramic powder to keep their dispersed state in the paste. Representatively, any of menbaden fish oil, polyethyleneimine, glyceryl triolate, polyacrylic acid, corn oil, polyisobutylene, linoleic acid, stearic acid, ammonium salt, salt acrylic acid, salt of poly acrylic acids, salt of methacrylic acids, linseed oil, glycerol triolate, sodium silicate, dibutylamine, ethoxylate and phosphate ester, or their mixtures may be used for the dispersion agent (d-1).

The defoaming agent (d-2) acts for removing foams by changing a surface property of the glass powder and the ceramic powder and decreasing interfacial tension of the solvent. The stabilization of the foams may be controlled by means of Gibbs repulsive force, though being controlled by electrostatic characteristics out of the particles. In many cases, the defoaming agent is same as the dispersion agent, so its compound is not described in detail here.

The wetting agent (d-3) is not specially limited, and alkyl benzene, di-iso butyl ketone, di-pentene, methoxy propyl acetate, xylenes, butyl glycol and cyclohexanol may be preferably used.

The dispersion agent, the defoaming agent and the wetting agent are a kind of surfactants which gives properties suitable for the compositions for forming barrier ribs according to the present invention by changing surface characteristics of the components of the composition. These agents are not limited to the above-mentioned compounds, but in some cases, one compound or a kind of mixed compound may realize all features of these agents.

The coupling agent (e) is not specially limited. For preferably examples, tri-methoxy silane, 3-aminopropyl trimethoxy silane and 3-glycidoxypropyl trimethoxy silane may be used as the coupling agent. The coupling agents may be used along or mixed. An added amount of the coupling agent is preferably 0.01 to 5 wt % on the basis of the ceramic powder.

The reactive diluting agent (f) is a component for dissolving the organic additive agents such as the organic binder, the dispersion agent and the curing agent so as to give suitable viscosity during the thick film coating process. As representative examples, the diluting agent may use aliphatic glycidyl ether and aromatic glycidyl ether. As for non-reactive diluting agents, diethyl oxalate, polyethylene, polyethylene glycol (PEG), dimethyl phthalate (DMP), dibutyl phthalate (DBP), dioctyl phthalate (DOP), butyl benzyl phthalate, polyalkylene glycols, polypropylene glycol (PPG), tri-ethylene glycol propylene carbonate and butyl stearate may be used. Sometimes, the compounds may realize characteristics of several components either alone or together.

Organic matters in the composition of the present invention are resolved below the plasticizing temperature of the barrier ribs, and thus do not affect on the sintering density with giving an appropriate viscosity range during the thick film coating process, thereby giving suitable viscosity in the thickness range, namely 5 to 100 μm, of the thick film required for making the lower plate of PDP.

In addition to the essential components, other components for reinforcing the barrier ribs and contributing to the convenience of process may be added to the composition of the present invention if they do not deteriorate the properties of the composition. In addition, other additional processes may be used without damaging the intention of the present invention.

The present invention also provides a plasma display panel (PDP) which is manufactured with the use of the lower plate in which the above-mentioned barrier ribs are formed. The method of manufacturing PDP with the use of the lower plate in which the barrier ribs is formed is well known in the art, and not described in detail.

Now, more concrete examples of the present invention are described with reference to the following embodiments, but the scope of the invention is not limited to the following examples of course.

Embodiment 1

100 g of powder including glass powder and alumina powder in the ratio of 8:2 is well mixed and then ball-milled for 8 hours. To this powder mixture, 17 wt % of thermosetting resin (e.g., bisphenol A epoxy resin or cycloalkyl epoxy resin) is added on the basis of the overall powder. And then, 13 wt % of LGE (manufactured by Kookdo Chemical Co. Ltd.) as a reactive diluting agent, 3 wt % of BF3-monoethylenediamine as a thermosetting initiator, 1 wt % of silicon (Si) surfactant (BYK-333/BYK-111/BYK-082: manufactured by BYK-Chemical Co. Ltd.) as wetting/dispersion/defoaming agents, and 0.8 wt % of tri-methoxy silane as a coupling agent are mixed together, namely mixed in a revolution-rotation mixer for 15 minutes, then mixed four times by using a 3-Roll mill and then mixed in the revolution-rotation mixer agent for 10 minutes to make a thermosetting paste.

Figure 7:
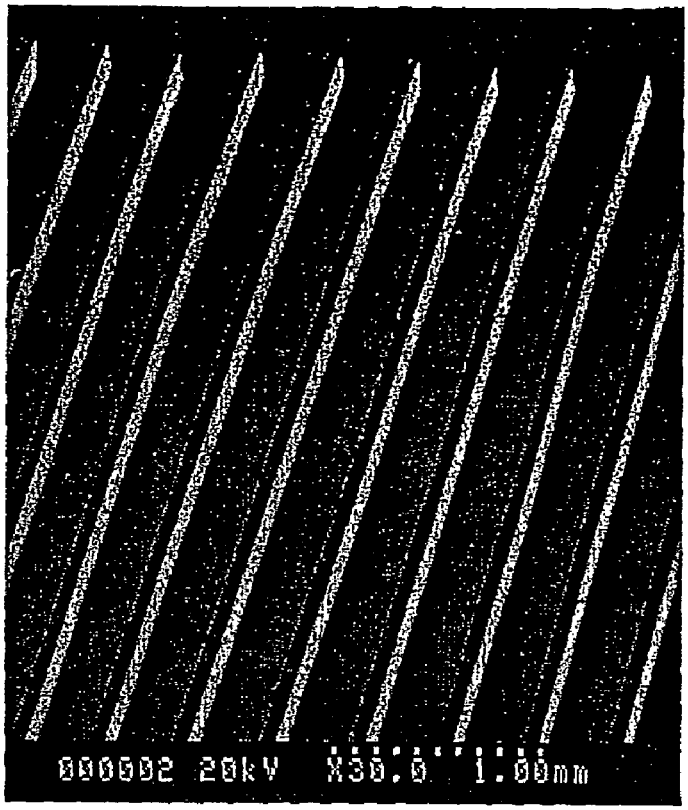
FIG. 7 is a picture photographed by the scanning electron microscope for showing a section of the barrier rib manufactured according to the first embodiment.

The paste is then coated on a sodalime glass substrate on which the electrodes and the dielectric are coated, by means of the screen printing to make a thick film of 40 μm. Then, a groove mold having a fine strip pattern for the lower plate barrier ribs is positioned on the thick film so that the paste is infiltrated into the mold at 60° C. by means of the capillary phenomenon. The paste infiltrated into the grooves of the mold is thermally hardened at about 140° C. for about 1.5 hour, and then the mold is removed to make the barrier ribs for the PDP rear plate. The shaped mold is sintered at 570° C. for 30 minutes to make barrier ribs having a height of 120 μm, a thickness of 50 μm and a cell pitch of 360 μm. The barrier ribs are then observed by using a scanning electron microscope in order to check that a desired barrier rib is formed on the glass substrate. As a result of the observation, it is found that the barrier ribs are formed as shown in FIG. 7.

Embodiment 2

Barrier ribs are manufactured in the same way as the first embodiment, except that the composition for manufacturing barrier ribs contains components as seen in the following Table 1.

TABLE 1

| | Compound | Content (g) |
|---|---|---|
| Thermosetting resin | YH-300 (Kookdo Chemical) | 25 |
| Thermosetting initiator | BF-3 monoethylamine | 2 |
| Dispersion agent | BYK-111 | 1.5 |
| Reactive diluting agent | none | |

TABLE 1-continued

| | Compound | Content (g) |
|---|---|---|
| Defoaming agent | BYK-083 | 0.5 |
| Coupling agent | Trimethoxy silane | 0.5 |
| Wetting agent | BYK-333 | 0.5 |

Though the reactive diluting agent is not contained in the paste of this embodiment, the capillary molding is possible because the viscosity of the used binder is low.

Figure 8:
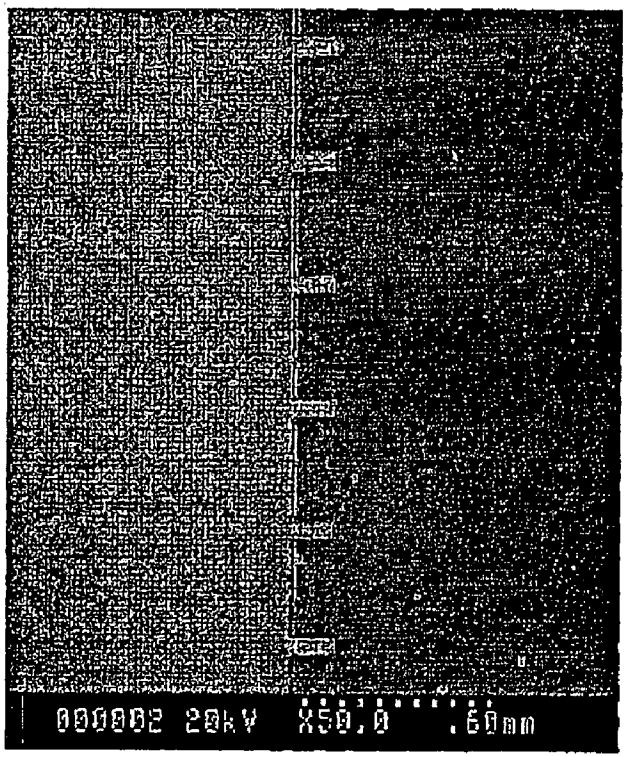
FIG. 8 is a picture photographed by the scanning electron microscope for showing a section of the barrier rib manufactured according to the second embodiment.

The barrier ribs are then observed by using a scanning electron microscope in order to check that a desired barrier rib is formed on the thick film on the glass substrate. As a result of the observation, it is found that the barrier ribs are formed to have an average height of 120 μm and an average thickness of 60 μm, as shown in FIG. 8.

Embodiment 3

Barrier ribs are formed by using composition including components as suggested in the following Table 2 through the same way as the first embodiment. However, this embodiment is different from the first embodiment just in the print that glass powder and alumina powder are initially added to the reactive diluting agent and the dispersion agent, which have relative low viscosity so as to basically make a uniform dispersion state, and then other additives are added.

As a result of checking the shape of the obtained barrier ribs through a scanning electron microscope, it is found that more uniform fine structure is obtained.

TABLE 2

| | Compound | Content (g) |
|---|---|---|
| Thermosetting resin | ERL-4221 (Kookdo Chemical) | 20 |
| Thermosetting initiator | BF-3 monoethylamine | 2 |
| Dispersion agent | BYK-111 | 1.5 |
| Reactive diluting agent | LGE | 5 |
| Defoaming agent | BYK-083 | 0.5 |
| Coupling agent | Trimethoxy silane | 0.5 |
| Wetting agent | BYK-333 | 0.5 |

Embodiments 4 to 6

Figure 9A:
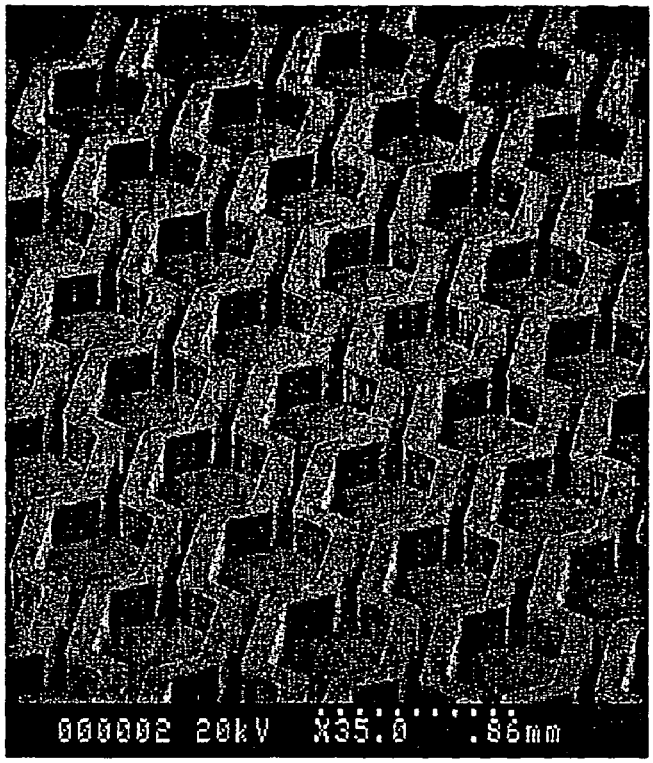
FIGS. 9A to 9C show pictures of the barrier ribs manufactured according to the fourth to sixth embodiments, which are photographed by the scanning electron microscope.
Figure 9B:
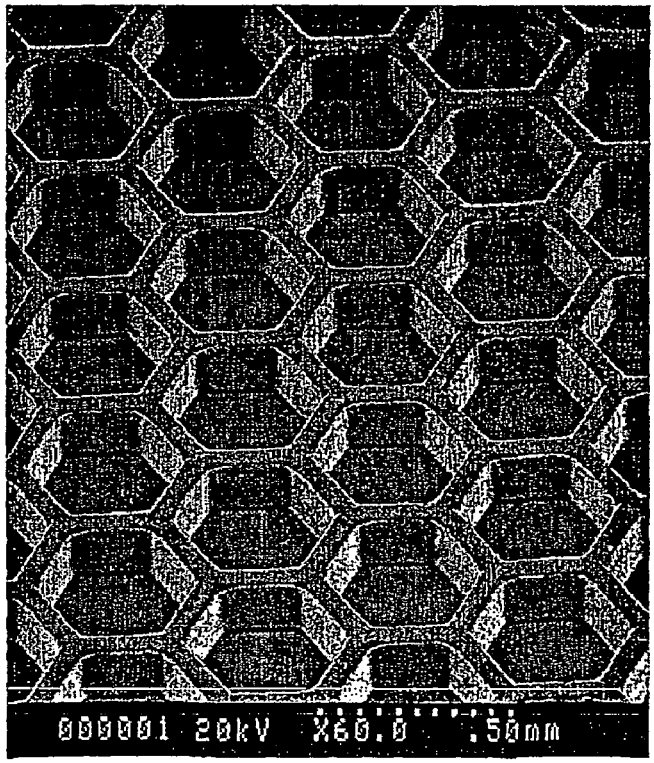
Figure 9C:
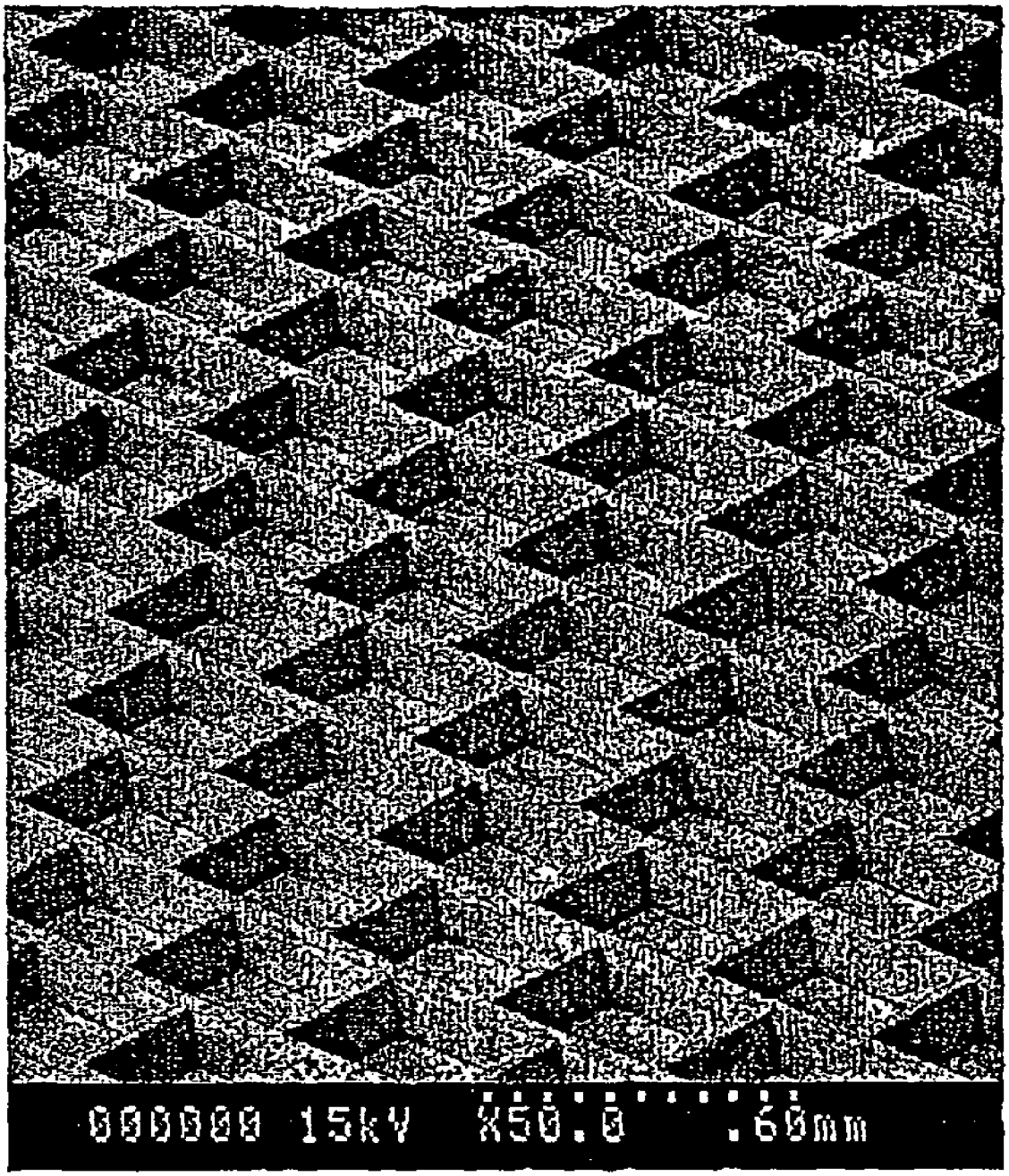

Barrier ribs are manufactured in the same way as the first embodiment, except that the meander mold (embodiment 4), the honeycomb mold (embodiment 5) and the SDR mold (embodiment 6) are used instead of the strip pattern mold. Pictures obtained by photographing the manufactured barrier ribs with a scanning electron microscope are shown in FIGS. 9A to 9C. As shown in those figures, it can be seen that the barrier ribs manufactured by the method of the present invention have very precise shape, compared with barrier ribs according to the conventional manufacturing method.

INDUSTRIAL APPLICABILITY

As described above, by using the method of manufacturing barrier ribs for DPD and the paste compositions for the method according to the present invention, it is possible to prevent conventional problems such as industrial waste and dust generation caused by the sand blasting and mechanical damage of the barrier ribs since the barrier ribs are manufactured by infiltrating the formed thick film into the grooves of the mold by means of the capillary phenomenon. In other words, it is possible to prevent environmental pollution, which may be generated during forming the barrier rib, by using a pollution-free capillary molding. In addition, since the barrier ribs are formed by infiltrating the paste into the groove of the mold in fine pitch by means of LIGA manner, it is possible to manufacture the fine pitch barrier ribs having a high width-length ratio, particularly barrier ribs having complex shapes such as meander type. As a result, the manufacturing method and the composition of the present invention may improve product reliability of the rear plate of PDP, production yield and quality uniformity, and the barrier rib shaping process used in the method may dramatically reduce the manufacture costs of the rear plate of PDP.

Various changes and modifications within the spirit and scope of the invention will become apparent to those skilled in the art from this detailed description.

What is claimed is:

1. A method of manufacturing rear plate barrier ribs for a Plasma Display Panel (PDP) comprising the steps of:

forming a thick film for barrier ribs by coating barrier rib forming paste, which has a wetting angle to a mold less than 90° and a viscosity in usage state less than 20000 cP and includes thermosetting and/or photosensitive binder component, on a glass or metal substrate (or, glass or metal lower plate);

positioning a mold, in which a barrier rib shape is imprinted, above the thick film so that the paste is infiltrated into grooves of the mold by means of the capillary phenomenon, and then curing the infiltrated paste; and releasing the mold from the cured barrier ribs and then sintering the barrier ribs.

2. A method of manufacturing rear plate barrier ribs for PDP according to claim 1, wherein the viscosity of the paste in usage state is less than 15000 cP.

3. A method of manufacturing rear plate barrier ribs for PDP according to claim 1, wherein the method executes one or at least two of the following ways: (i) using binder component having a low viscosity; (ii) adding a diluting agent having a low viscosity into the paste; (iii) increasing the temperature of the paste in usage state; and (iv) lowering the content of inorganic powder including glass powder and ceramic powder, so that the viscosity of the paste in usage state is lowered.

4. A method of manufacturing rear plate barrier ribs for PDP according to claim 3, wherein the temperature in usage state of the way (iii) is ranged between 50° C. and 70° C.

5. A method of manufacturing rear plate barrier ribs for PDP according to claim 1, wherein the capillary molding of the paste is conducted under the vacuum circumstance of 600 torr~$10^{-6}$ torr.

6. A method of manufacturing rear plate barrier ribs for PDP according to claim 5, wherein the vacuum circumstance is 600 torr~10 torr.

7. A method of manufacturing rear plate barrier ribs for PDP according to claim 1, wherein, during the capillary molding of the paste, the mold is bent so that a center portion of the mold temporarily forms a smooth curve protruded downward, and the molding is conducted while the bent mold is slowly spread.

8. A method of manufacturing rear plate barrier ribs for PDP according to claim 1, wherein the method comprises the steps of:

(1) making the paste having a wetting angle to a mold less than 90° and a viscosity in usage state less than 20000 cP by mixing glass powder and ceramic powder so that a mixing ratio is in the range between 50:50 and 95:5, and then mixing 2 to 20 wt % of thermosetting and/or photosensitive binder, 0.1 to 10 wt % of thermosetting and/or photosensitive initiator, 0.01 to 10 wt % of surfactant (dispersion agent, defoaming agent or wetting agent) and 0.01 to 5 wt % of coupling agent on the basis if 100 wt % of the mixed powder;

(2) making a thick film by coating the paste on the glass or metal rear plate in the thickness of 5 to 100 μm;

(3) forming barrier ribs by positioning the mold, in which a barrier rib shape is imprinted , on the paste so that the paste is infiltrated into the grooves of the mold by means of the capillary phenomenon;

(4) curing the substrate and the paste filled in the grooves of the mold by heating or UV radiation, and then releasing the mold; and (5) sintering the specimen at 450° C. to 600° C. for 0.5 to 1 hour.

* * * * *